US010372050B2

(12) United States Patent
Nishi et al.

(10) Patent No.: US 10,372,050 B2
(45) Date of Patent: Aug. 6, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masashi Nishi, Susono (JP); Kunihiko Sekido, Suntou-gun (JP); Michiyo Sekiya, Atami (JP); Hiroyuki Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/982,656

(22) Filed: May 17, 2018

(65) Prior Publication Data

US 2018/0341190 A1 Nov. 29, 2018

(30) Foreign Application Priority Data

May 25, 2017 (JP) ..... 2017-103902

(51) Int. Cl.
*G03G 5/14* (2006.01)
*G03G 21/18* (2006.01)

(52) U.S. Cl.
CPC ..... *G03G 5/142* (2013.01); *G03G 21/18* (2013.01)

(58) Field of Classification Search
CPC ..... G03G 5/142
See application file for complete search history.

(56) References Cited

U.S. PATENT DOCUMENTS 5,154,996 A * 10/1992 Makino ..... G03G 5/0546 430/59.6
5,455,135 A 10/1995 Maruyama et al.
5,604,061 A 2/1997 Sekido et al.
5,693,443 A 12/1997 Nakamura et al.
6,110,628 A 8/2000 Sekiya et al.
6,228,546 B1 5/2001 Kashizaki et al.
6,372,397 B1 4/2002 Maruyama et al.
(Continued)

FOREIGN PATENT DOCUMENTS

JP 3717320 11/2005
JP 2011095664 A * 5/2011
JP 2014-215477 11/2014

OTHER PUBLICATIONS

"Cross-linking agent handbook", published by Yamashita Shinzo, Kaneko Tousuke, Taiseisha Ltd., (1981).

*Primary Examiner* — Christopher D Rodee
(74) *Attorney, Agent, or Firm* — Venable LLP

(57) ABSTRACT

The present invention provides an electrophotographic photosensitive member in which a photosensitive layer has strong close adhesiveness even when used repeatedly, and a positive ghost is reduced. An undercoat layer of the electrophotographic photosensitive member contains a cured product of an electron transport material having a polymerizable functional group; a polyolefin resin having at least one group/structure selected from the group consisting of a carboxyl group, an alkoxycarbonyl group and an anhydrous carboxylic acid structure, and a substituted or unsubstituted phenyl group; and an isocyanate compound having two or more isocyanate groups.

9 Claims, 4 Drawing Sheets

(56) References Cited

U.S. PATENT DOCUMENTS 6,376,144 B1 * 4/2002 Baumann ..... G03G 5/0208 430/49.46
6,436,597 B2 8/2002 Maruyama et al.
6,664,014 B1 12/2003 Kikuchi et al.
7,141,341 B2 11/2006 Sekido et al.
7,378,205 B2 5/2008 Sekiya et al.
8,343,699 B2 1/2013 Nagasaka et al.
8,465,889 B2 6/2013 Sekido et al.
8,524,430 B2 9/2013 Takagi et al.
8,546,050 B2 10/2013 Maruyama et al.
8,632,931 B2 * 1/2014 Sekido ..... G03G 5/0532 399/159
8,795,936 B2 8/2014 Sekido et al.
9,029,054 B2 5/2015 Okuda et al.
9,063,505 B2 6/2015 Sekiya et al.
9,069,267 B2 6/2015 Kaku et al.
9,164,406 B2 10/2015 Nishi et al.
9,207,550 B2 12/2015 Okuda et al.
9,280,072 B2 3/2016 Ogaki et al.
9,335,645 B2 5/2016 Tagami et al.
9,442,401 B2 9/2016 Sekido et al.
9,477,163 B2 10/2016 Nishi et al.
9,523,929 B2 12/2016 Nakamura et al.
9,535,346 B2 1/2017 Sekiya et al.
9,760,030 B2 9/2017 Sekiya et al.
9,772,568 B2 9/2017 Sekido et al.
9,811,011 B2 11/2017 Nishi et al.
9,851,648 B2 12/2017 Nishi et al.
9,864,285 B2 * 1/2018 Nishi ..... G03G 5/142
9,921,498 B2 3/2018 Sekido et al.
2015/0185630 A1 7/2015 Ito et al.
2015/0185634 A1 7/2015 Sekiya et al.
2015/0185636 A1 * 7/2015 Sekiya ..... G03G 5/14 430/56

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including an electrophotographic photosensitive member.

Description of the Related Art

In an electrophotographic photosensitive member using an electrophotographic process, a technique of providing a charge-transporting cured film as an undercoat layer between a support and a charge generation layer (photosensitive layer) is known for having purposes of improving durability and further, of suppressing occurrence of image defects such as black spots, and the like, caused by charge injection from a support side to a photosensitive layer side.

However, when using the cured film as the undercoat layer, close adhesiveness between the undercoat layer and the charge generation layer is deteriorated, and as a result, a ghost phenomenon may occur.

As a technique for suppressing the deterioration of close adhesiveness between the layers, a technique for containing a compound for improving the close adhesiveness in the undercoat layer is known (Japanese Patent Application Laid-Open No. 2014-215477). Japanese Patent Application Laid-Open No. 2014-215477 discloses that an undercoat layer contains an electron transport material having a specific structure.

SUMMARY OF THE INVENTION

The present invention relates to an electrophotographic photosensitive member sequentially including: a support; an undercoat layer; a charge generation layer; and a charge transport layer, wherein the undercoat layer comprises a cured product of an electron transport material having at least one group selected from the group consisting of a hydroxyl group, a thiol group, an amino group, and a carboxyl group;

a polyolefin resin having at least one group/structure selected from the group consisting of a carboxyl group, an alkoxycarbonyl group and an anhydrous carboxylic acid structure, and a substituted or unsubstituted phenyl group; and an isocyanate compound having two or more isocyanate groups.

In addition, the present invention relates to a process cartridge including the electrophotographic photosensitive member; and at least one unit that are integrally supported, the at least one unit being selected from the group consisting of a charging unit, a developing unit, a transfer unit, and a cleaning unit, and being detachably attachable to an electrophotographic apparatus main body.

In addition, the present invention relates to an electrophotographic apparatus including the electrophotographic photosensitive member; a charging unit, an exposing unit, a developing unit, and a transfer unit.

Further features of the present invention will become apparent from the following description of exemplary embodiments with reference to the attached drawings.

DESCRIPTION OF THE EMBODIMENTS

Figure 1:
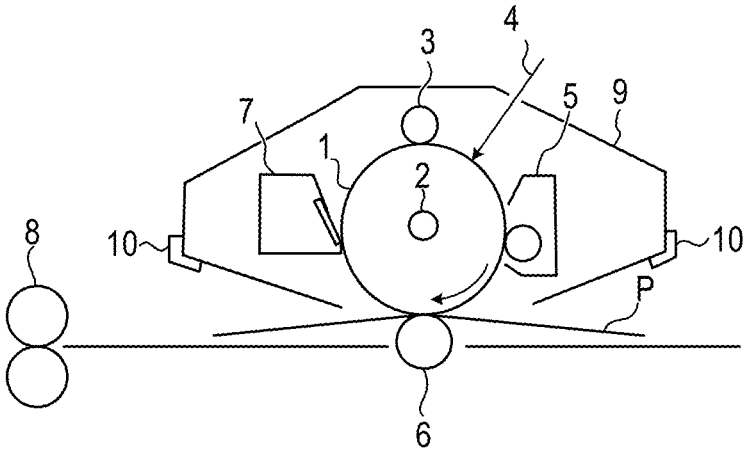
FIG. 1 is a view illustrating a schematic construction in an example of an electrophotographic apparatus including a process cartridge provided with an electrophotographic photosensitive member.

Preferred embodiments of the present invention will now be described in detail in accordance with the accompanying drawings.

In recent years, demand for high speed of image output, and quality of image has increased, and further an allowable range for the above-described close adhesiveness has become increasingly strict in order to improve usability and meet a demand of high durability. Thus, as a result of the studies conducted by the present inventors, improvement regarding a technique disclosed in Japanese Patent Application Laid-Open No. 2014-215477 has been still required.

An object of the present invention is to provide an electrophotographic photosensitive member in which close adhesiveness between an undercoat layer and a charge generation layer is improved and a ghost phenomenon is reduced, and a process cartridge and an electrophotographic apparatus including the electrophotographic photosensitive member.

In the present invention, the undercoat layer of the electrophotographic photosensitive member contains a cured product of an electron transport material having at least one group selected from the group consisting of a hydroxyl group, a thiol group, an amino group, and a carboxyl group; a polyolefin resin having at least one group/structure selected from the group consisting of a carboxyl group, an alkoxycarbonyl group and an anhydrous carboxylic acid structure, and a substituted or unsubstituted phenyl group; and an isocyanate compound having two or more isocyanate groups.

The present inventors have assumed that a reason why the close adhesiveness with the charge generation layer is improved by containing the above-described cured product in the undercoat layer is as follows.

In general, it is known that there are two types of peeling of a laminated film. One is "interfacial delamination" which is delamination that occurs at an interface between two layers, and the other one is "cohesion failure" which is delamination caused by destruction of an inner part of one layer. It is assumed that the deterioration of the close adhesiveness appears as a result derived by complex occurrence of the delamination phenomenon. By using the cured product in the undercoat layer, an interaction with the charge generation layer as an upper layer is deteriorated as compared to a case in which the cured product is not used in the undercoat layer. Further, by containing the cured product, the layer itself is hard and weak. Due to this, the close adhesiveness is deteriorated.

In the present invention, the undercoat layer contains a cured product of an electron transport material having a polymerizable functional group; a polyolefin resin having a substituted or unsubstituted phenyl group and a carboxylic acid derivative structure; and an isocyanate compound. Accordingly, the carboxylic acid derivative of the polyolefin resin reacts with an isocyanate group to form an amide bond.

It is known that the amide bond has stronger hydrogen bonding property as compared to other chemical bonds, and the bond itself is rigid and firm. As the hydrogen bonding property becomes stronger, an interaction with the charge generation layer becomes stronger, and thus the "interfacial delamination" may be suppressed, and a strength of the undercoat layer itself may be increased due to the rigid and firm bond itself, thereby suppressing the "cohesion failure". It is considered that as a result of combining these effects, the close adhesiveness is improved.

In addition, a resin having a carboxylic acid derivative has a high polarity and is often inferior in compatibility with an electron transport material and an isocyanate compound. However, it is considered that the polyolefin resin used in the present invention has not only the carboxylic acid derivative but also the substituted or unsubstituted phenyl group to be mixed well with other compositions, and thus a uniform cured film is formed. Therefore, it is considered that there is no stress concentration, or the like, that causes the deterioration of the close adhesiveness in the non-uniform film, and thus the close adhesiveness is improved.

[Electron Transport Material]

The electron transport material contained in the undercoat layer has at least one group selected from the group consisting of a hydroxyl group, a thiol group, an amino group, and a carboxyl group while having an electron transport ability. Examples of the electron transport material include a ketone compound, a quinone compound, an imide compound, and a cyclopentadienylidene compound. Specific examples thereof include a compound represented by any one of Formulas (A1) to (A11) below.

(A1)

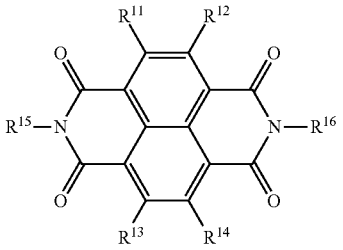

(A2)

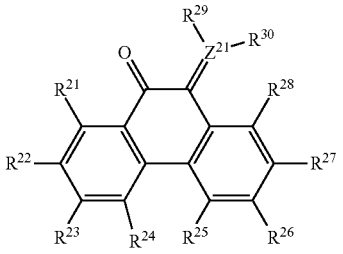

-continued (A3)

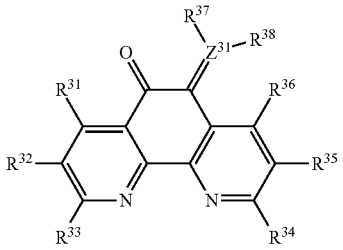

(A4)

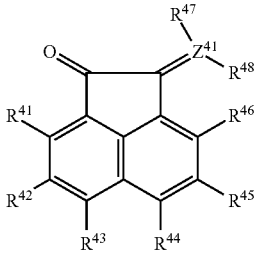

(A5)

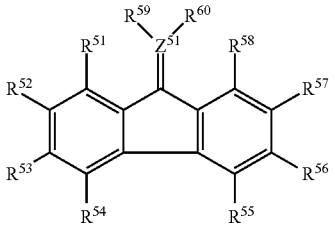

(A6)

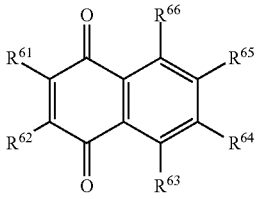

(A7)

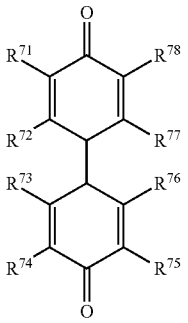

(A8)

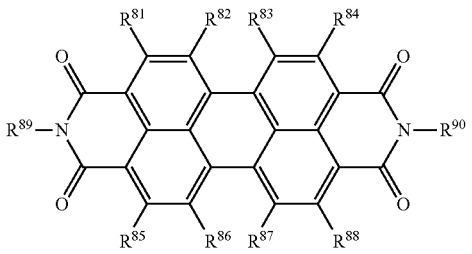

-continued (A9)

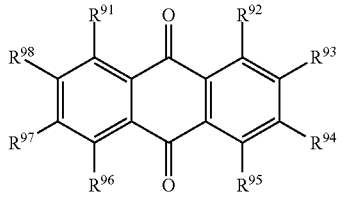

(A10)

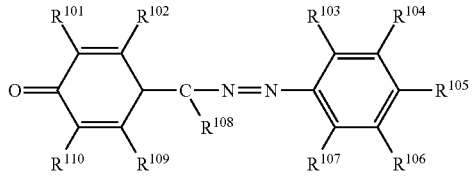

(A11)

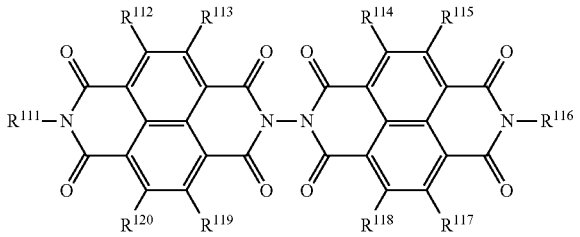

In Formulas (A1) to (A11), $R^1$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$, and $R^{111}$ to $R^{120}$ each independently represent a monovalent group represented by Chemical Formula (I) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. One of the carbon atoms in a main chain of the alkyl group may be substituted with O, S, NH or $NR^{121}$ ($R^{121}$ is an alkyl group). At least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ have a monovalent group represented by Formula (I) below.

A substituent of the substituted alkyl group is an alkyl group, an aryl group, a halogen atom, or an alkoxycarbonyl group. The substituent of the substituted aryl group or a substituent of the substituted heterocyclic group is a halogen atom, a nitro group, a cyano group, an alkyl group, a halogen-substituted alkyl group, or an alkoxy group. $Z^{21}$, $Z^{31}$, $Z^{41}$ and $Z^{51}$ each independently represent a carbon atom, a nitrogen atom, or an oxygen atom. When $Z^{21}$ is an oxygen atom, $R^{29}$ and $R^{30}$ do not exist, and when $Z^{21}$ is a nitrogen atom, $R^{30}$ does not exist. When $Z^{31}$ is an oxygen atom, $R^{37}$ and $R^{38}$ do not exist, and when $Z^{31}$ is a nitrogen atom, $R^{38}$ does not exist. When $Z^{41}$ is an oxygen atom, $R^{47}$ and $R^{48}$ do not exist, and when $Z^{41}$ is a nitrogen atom, $R^{48}$ does not exist. When $Z^{51}$ is an oxygen atom, $R^{59}$ and $R^{60}$ do not exist, and when $Z^5$ is a nitrogen atom, $R^{60}$ does not exist.

$$-(\alpha)_l-(\beta)_m\gamma \quad (I)$$

In Formula (I), at least one of α, β, and γ is a group having a polymerizable functional group, and the polymerizable functional group is at least one group selected from the group consisting of a hydroxyl group, a thiol group, an amino group, and a carboxyl group. In Formula (I), l and m are each independently 0 or 1, and the sum of l and m is 0 or more to 2 or less.

In Formula (I), α represents an alkylene group having 1 to 6 carbon atoms in the main chain, an alkylene group having 1 to 6 carbon atoms in the main chain substituted with an alkyl group having 1 to 6 carbon atoms, an alkylene group having 1 to 6 carbon atoms in the main chain substituted with a benzyl group, an alkylene group having 1 to 6 carbon atoms in the main chain substituted with an alkoxycarbonyl group, or an alkylene group having 1 to 6 carbon atoms in the main chain substituted with a phenyl group. These groups may have a polymerizable functional group. One of the carbon atoms in a main chain of the alkylene group may be substituted with O, S, or $NR^{122}$ (in Formula, $R^{122}$ represents a hydrogen atom or an alkyl group).

In Formula (I), β represents a phenylene group, an alkyl-substituted phenylene group having 1 to 6 carbon atoms, a nitro-substituted phenylene group, a halogen-substituted phenylene group, or an alkoxy group-substituted phenylene group. These groups may have a polymerizable functional group.

In Formula (I), γ represents a hydrogen atom, an alkyl group having 1 to 6 carbon atoms in the main chain, or an alkyl group having 1 to 6 carbon atoms in the main chain substituted with an alkyl group having 1 to 6 carbon atoms. These groups may have a polymerizable functional group. One of the carbon atoms in a main chain of the alkyl group may be substituted with O, S, or $NR^{123}$ (in Formula, $R^{123}$ represents a hydrogen atom or an alkyl group).

A derivative (derivative of electron transport materials) having any one structure of Formulas (A2) to (A6) and (A9) may be commercially available from Tokyo Chemical Industry Co., Ltd., Sigma-Aldrich Japan, or Johnson Matthey Japan G.K. A derivative having a structure of Formula (A1) may be synthesized by a reaction of a naphthalene tetracarboxylic acid dianhydride and a monoamine derivative available from Tokyo Chemical Industry Co., Ltd., or Johnson Matthey Japan G.K. A derivative having a structure of Formula (A7) may be synthesized using a phenol derivative available from Tokyo Chemical Industry Co., Ltd. or Sigma-Aldrich Japan as a raw material. A derivative having a structure of Formula (A8) may be synthesized by a reaction of a perylene tetracarboxylic acid dianhydride and a monoamine derivative available from Tokyo Chemical Industry Co., Ltd. or Sigma-Aldrich Japan. A derivative having a structure of Formula (A10) may be, for example, synthesized by oxidizing a phenol derivative having a hydrazone structure with a suitable oxidizing agent such as potassium permanganate, or the like, in an organic solvent, using a known synthesis method described in Japanese Patent No. 3717320. A derivative having a structure of Formula (A11) may be synthesized by a reaction of a naphthalene tetracarboxylic acid dianhydride, a monoamine derivative, and a hydrazine available from Tokyo Chemical Industry Co., Ltd., Sigma-Aldrich Japan, or Johnson Matthey Japan G.K.

A compound represented by any one of Formulas (A1) to (A11) has a polymerizable functional group capable of polymerizing with a cross-linking agent (a hydroxyl group, a thiol group, an amino group and a carboxyl group). As a method for synthesizing the compound represented by any one of Formulas (A1) to (A11) by introducing the polymerizable functional group into the derivative having any one of Formulas (A1) to (A11), the following methods may be used.

For example, there is a method in which the derivative having any one structure of Formulas (A1) to (A11) is synthesized, and then the polymerizable functional group is directly introduced thereinto. There is also a method of introducing a structure having the polymerizable functional group or having a functional group capable of forming a precursor of the polymerizable functional group. As a method to be described below, there is a method of introducing an aryl group having a functional group by using a cross-coupling reaction utilizing, for example, a palladium catalyst and a base, based on a halide of the derivative having any one structure of Formulas (A1) to (A11). In addition, there is a method of introducing an alkyl group having a functional group by using a cross-coupling reaction utilizing a $FeCl_3$ catalyst and a base, based on a halide of the derivative having any one structure of Formulas (A1) to (A11). Further, there is a method of introducing a hydroxyalkyl group or a carboxyl group by acting an epoxy compound or $CO_2$ after lithiation based on a halide of the derivative having any one structure of Formulas (A1) to (A11).

As the electron transport material, more preferably, the electron transport material having a structure of Formula (A1), $R^{15}$ and $R^{16}$ are each independently a substituted or unsubstituted alkyl group having 2 to 6 carbon atoms, a group derived by substituting at least one $CH_2$ in a main chain of a substituted or unsubstituted alkyl group having 3 to 6 carbon atoms in the main chain with an oxygen atom, a group derived by substituting at least one $CH_2$ in the main chain of the substituted or unsubstituted alkyl group having 3 to 6 carbon atoms in the main chain with $NR^{124}$, a group derived by substituting at least one $C_2H_4$ in the main chain of the substituted or unsubstituted alkyl group having 3 to 6 carbon atoms in the main chain with COO, or a substituted aryl group. $R^{124}$ represents a hydrogen atom or an alkyl group having 1 to 4 carbon atoms, and a substituent of the substituted alkyl group, a group derived by substituting at least one $CH_2$ in the main chain of the substituted alkyl group with an oxygen atom, a group derived by substituting at least one $CH_2$ in the main chain of the substituted alkyl group with $NR^{124}$, and a group derived by substituting at least one $C_2H_4$ in the main chain of the substituted alkyl group with COO is a group selected from the group consisting of an alkyl group having 1 to 5 carbon atoms, a benzyl group, an alkoxycarbonyl group, a phenyl group, a hydroxyl group, a thiol group, an amino group, and a carboxyl group, and the substituent of the substituted aryl group is a group selected from the group consisting of a halogen atom, a cyano group, a nitro group, a methyl group, an ethyl group, an isopropyl group, an n-propyl group, an n-butyl group, an acyl group, an alkoxy group, an alkoxycarbonyl group, a hydroxyl group, a thiol group, an amino group, and a carboxyl group, and includes at least one hydroxyl group or carboxyl group, and $R^{11}$ to $R^{14}$ each independently represent a hydrogen atom, a halogen atom, a cyano group, a nitro group, a substituted or unsubstituted alkyl group having 1 to 6 carbon atoms, or a substituted or unsubstituted aryl group.

In addition, in view of film formability and electrical characteristics, a content of the electron transport material is preferably 40 mass % or more to 60 mass % or less, and more preferably 45 mass % or more to 55 mass % or less, of the entire undercoat layer.

Hereinafter, more specific examples of the electron transport material are shown, but the present invention is not limited thereto. Further, a plurality of electron transport materials may be used in combination.

TABLE 1

| Exemplary compound | Structure |
|---|---|
| A1-1 | 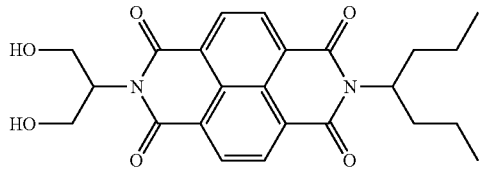 |
| A1-2 | 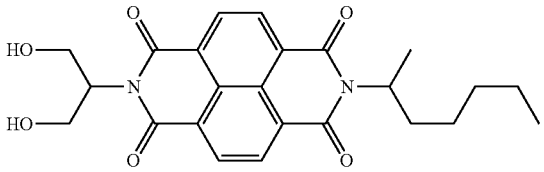 |
| A1-3 | 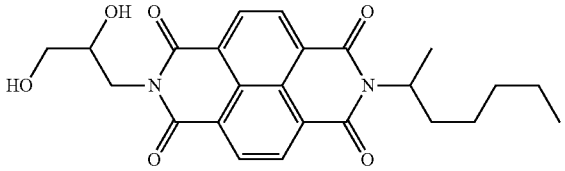 |

TABLE 1-continued

| Exemplary compound | Structure |
|---|---|
| A1-4 | 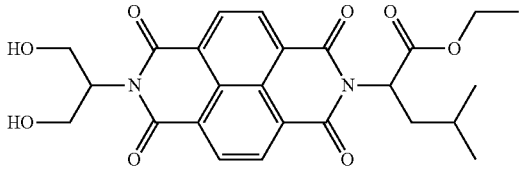 |
| A1-5 | 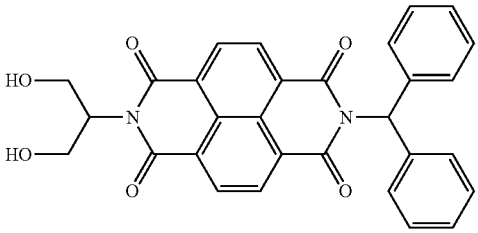 |
| A1-6 | 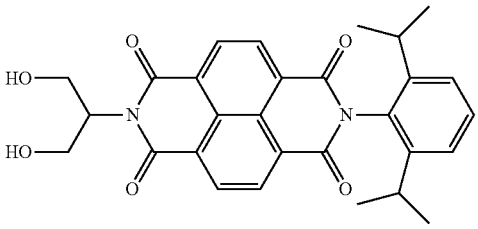 |
| A1-7 | 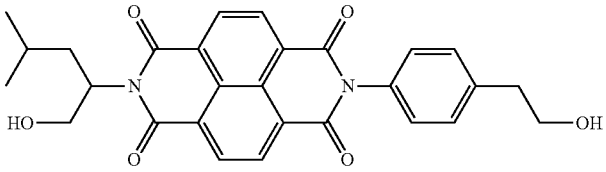 |
| A1-8 | 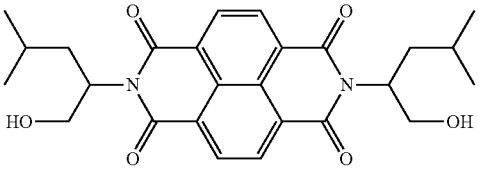 |
| A1-9 | 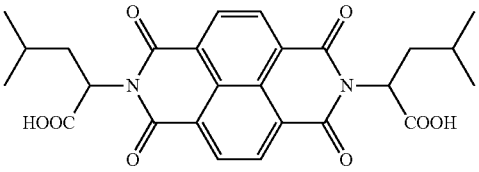 |
| A1-10 | 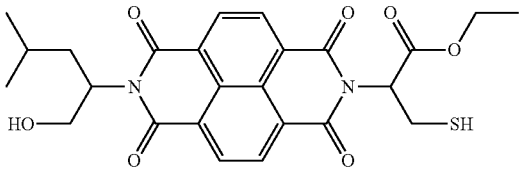 |

[Polyolefin Resin]

As the polyolefin resin, a resin having at least one group/structure selected from the group consisting of a carboxyl group, an alkoxycarbonyl group and an anhydride carboxylic acid structure, and a substituted or unsubstituted phenyl group, and being polymerized (cured) or cross-linked with an isocyanate compound can be used.

Further, the polyolefin resin is more preferably a resin having a structure represented by General Formula (B1) below and a structure represented by General Formula (B2) below.

(B1)

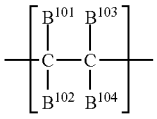

In Formula (B1), $B^{101}$ to $B^{104}$ are each independently at least one group selected from the group consisting of a hydrogen atom, a methyl group, and a substituted or unsubstituted phenyl group, and at least one of $B^{101}$ to $B^{104}$ is a substituted or unsubstituted phenyl group.

(B2)

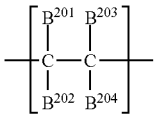

In Formula (B2), $B^{201}$ to $B^{204}$ are each independently at least one group selected from the group consisting of a hydrogen atom, a methyl group, a carboxyl group, and an alkoxycarbonyl group, and at least one of $B^{201}$ to $B^{204}$ is a carboxyl group or an alkoxycarbonyl group; or $B^{201}$ and $B^{203}$ are each independently a hydrogen atom or a methyl group, and $B^{202}$ and $B^{204}$ are bonded in a structure of —C(=O)OC(=O)—.

Examples of the polyolefin resin may include a styrene-maleic acid copolymer resin, a styrene-acrylic acid copolymer resin, and a styrene-acrylic acid ester copolymer resin. However, the present invention is not limited thereto. Further, a plurality of polyolefin resins may be used in combination.

Examples of the commercially available polyolefin resin may include acrylic resins such as ARUFON UC-3900, UC-3920, UF-5022, and UF-5041 manufactured by Toagosei Company, Limited, X-200, X-228, YS-1274, and RS-1191 manufactured by Seiko PMC Corporation, and SMA1000, SMA2000, SMA3000, SMA1440, and SMA2625 manufactured by Cray Valley HSC, and the like.

In addition, an acid value (mgKOH/g) of the polyolefin resin is preferably 150 or more. More preferably, the acid value is 200 or more.

[Isocyanate Compound]

As the isocyanate compound, a compound having two or more isocyanate groups and being polymerized (cured) or cross-linked with the electron transport material and the polyolefin resin can be used. Specifically, compounds that are described in "cross-linking agent handbook" published by Yamashita Shinzo, Kaneko Tousuke, TAISEISHA LTD., (1981), and the like, can be used.

The isocyanate compound may include, for example, the following isocyanate compounds, but the present invention is not limited thereto. Further, a plurality of isocyanate compounds may be used in combination.

An isocyanate compound having three or more isocyanate groups or block isocyanate groups is more preferable. For example, an isocyanurate modified product, a biuret modified product, an allophanate modified product of diisocyanate such as triisocyanate benzene, triisocyanate methylbenzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylene diisocyanate, 2,2,4-trimethylhexamethylene diisocyanate, methyl-2,6-diisocyanate hexanoate, norbornane diisocyanate, and the like, an adduct modified product with trimethylol propane or pentaerythritol, may be included. Among these, the biuret-modified product (biuret-type isocyanate compound) is more preferable.

The biuret-type isocyanate compound has a flexible structure as compared to an isocyanurate-type having a rigid cyclic structure, or the like, and thus flexibility of a polymeric material itself is also increased. It is considered that when the flexibility is increased, the resulting amide bond may be oriented so as to make an interaction with an upper layer stronger or can relax stress, and thus close adhesiveness is remarkably improved.

In addition, more preferably, there is provided a biuret-type isocyanate compound having the structure of Formula (1) below.

(1)

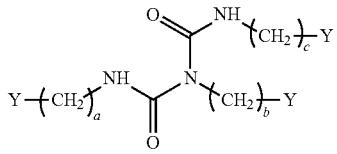

Y represents an isocyanate group or a block isocyanate group; and a, b, and c each independently represent an integer of 3 to 8.

The block isocyanate group is a group having a structure of —NHCO$X^1$ ($X^1$ is a protection group). $X^1$ may be any protection group as long as it is capable of being introduced into the isocyanate group, but more preferably, is a group represented by Formulas (H1) to (H6) below.

(H1)

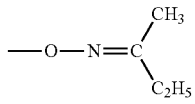

(H2)

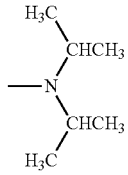

(H3)

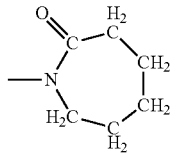

(H4)

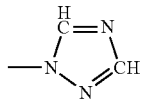

(H5)

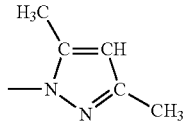

-continued
(H6)
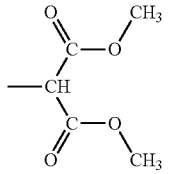
Specific examples of the isocyanate compound are shown below.
(B1)
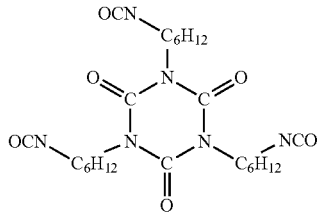
(B2)
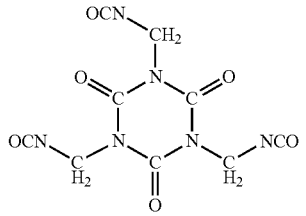
(B3)
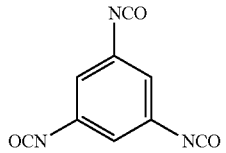
(B4)
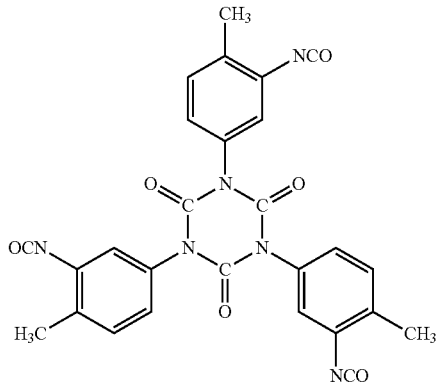
-continued
(B5)
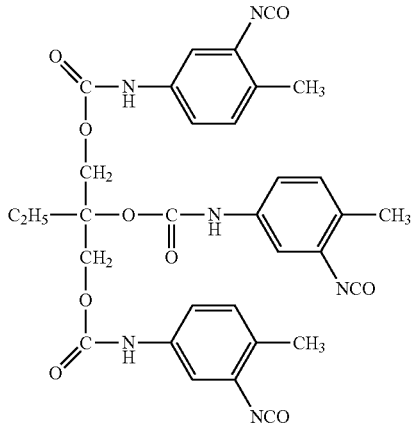
(B6)
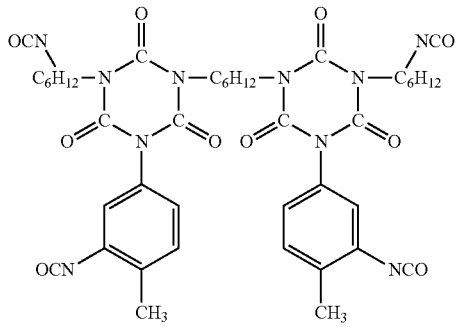
(B7)
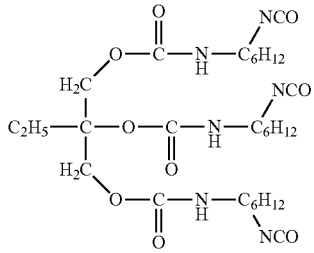
(B8)
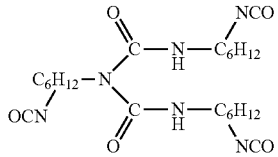
(B9)
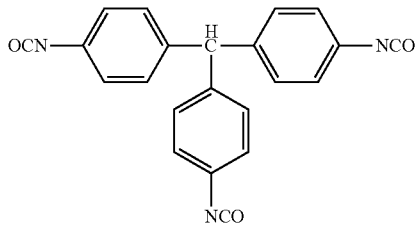

-continued
(B10)
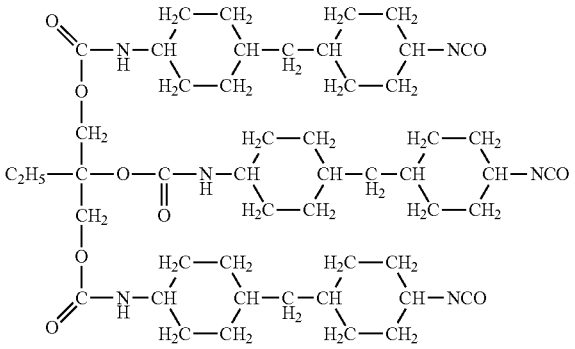
(B11)
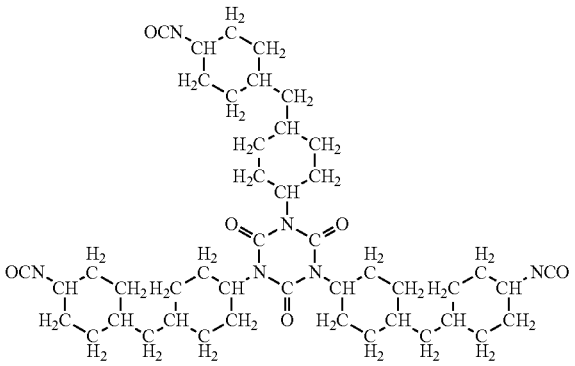
(B12)
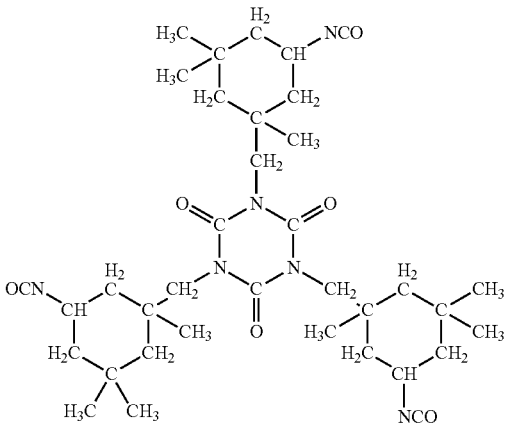
(B13)
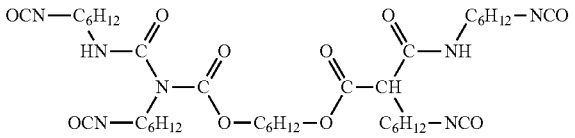
-continued
(B14)
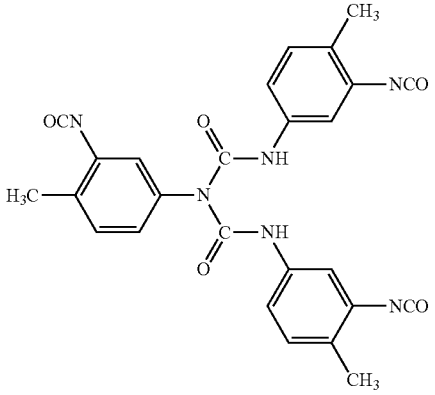
(B15)
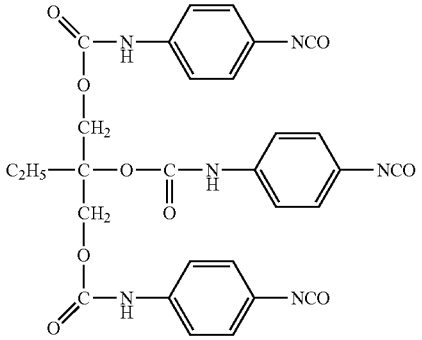
(B16)
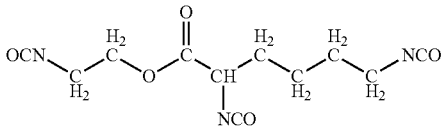
(B17)
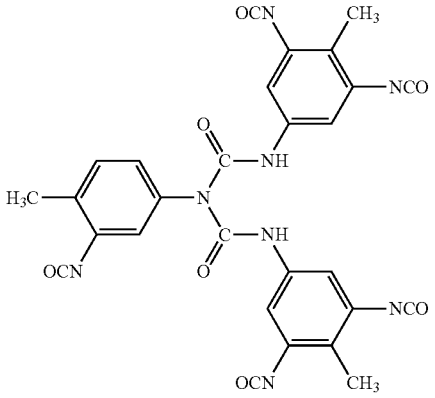

-continued (B18)

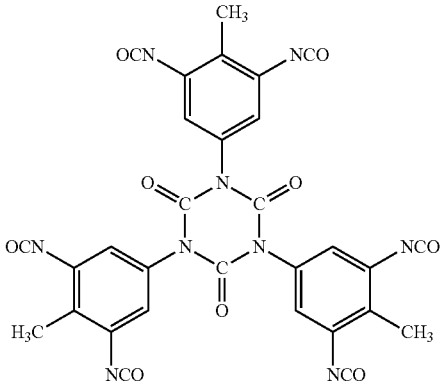

(B19)

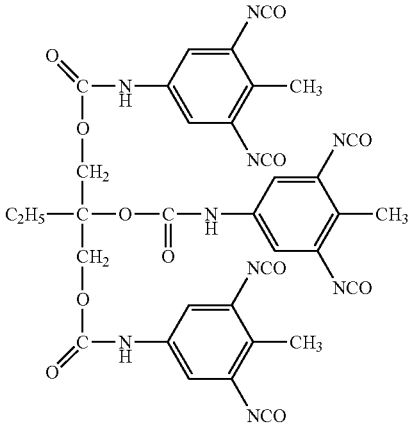

(B20)

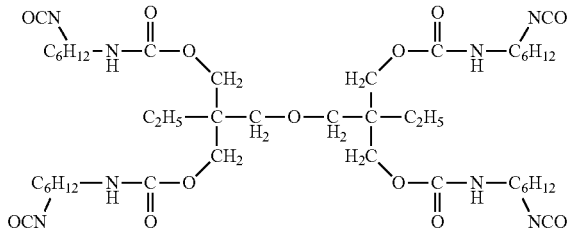

(B21)

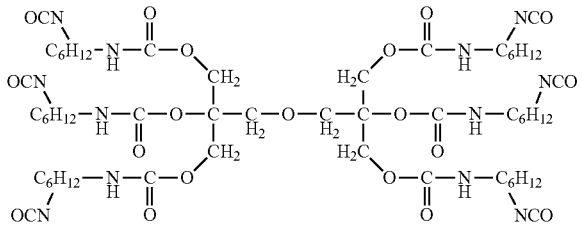

As commercially available isocyanate compounds, for example, Durante MF-K60B, SBA-70B, 17B-60P, SBN-70D, and SBB-70P manufactured by Asahi Kasei Corporation, Desmodur BL3175, and BL3475 manufactured by Sumika Covestro Urethane Co., Ltd., and the like, may be included. Among these, 17B-60 P and SBB-70P are biuret-type isocyanate compounds.

In view of compatibility between electrical characteristics and close adhesiveness, a ratio between a material amount of the isocyanate group included in a composition before curing a cured product contained in the undercoat layer and a total of a material amount of a polymerizable functional group of an electron transport material and a carboxyl group, an alkoxycarbonyl group, and an anhydrous carboxylic acid included in a polyolefin resin (represented by isocyanate group/(polymerizable functional group+carboxyl group, alkoxycarbonyl group, and anhydrous carboxylic acid)) is preferably 0.9 or more to 1.1 or less. More preferably, the ratio is 0.95 or more to 1.05 or less.

In addition, it is preferred that the polyolefin resin contained in the undercoat layer is 0.2 mass % or more to 8.0 mass % or less of the entire undercoat layer, the charge generation layer contains a phthalocyanine pigment and a resin, and a ratio between the phthalocyanine pigment and the resin (phthalocyanine pigment/resin) contained in the charge generation layer is 1.0 or more to 3.0 or less. More preferably, the polyolefin resin contained in the undercoat layer is 1.0 mass % or more to 6.5 mass % or less of the entire undercoat layer, and the ratio between the phthalocyanine pigment and the resin contained in the charge generation layer is 1.0 or more to 2.0 or less.

The undercoat layer can be formed by forming a coating film of a coating liquid for an undercoat layer containing a composition including an electron transport material; a polyolefin resin; and an isocyanate compound, and drying the coating film. When the coating film of the coating liquid for an undercoat layer is dried, these compositions are polymerized. At this time, by applying heat or light energy, a polymerization reaction (curing reaction) is promoted.

Examples of a solvent used for the coating liquid for the undercoat layer may include an alcohol-based solvent, a sulfoxide-based solvent, a ketone-based solvent, an ether-based solvent, an ester-based solvent, an aromatic hydrocarbon solvent, and the like.

A film thickness of the undercoat layer is preferably 0.2 μm or more to 3.0 μm or less, and more preferably 0.4 μm or more to 1.5 μm or less.

[Overall Constitution of Electrophotographic Photosensitive Member]

Figure 4:
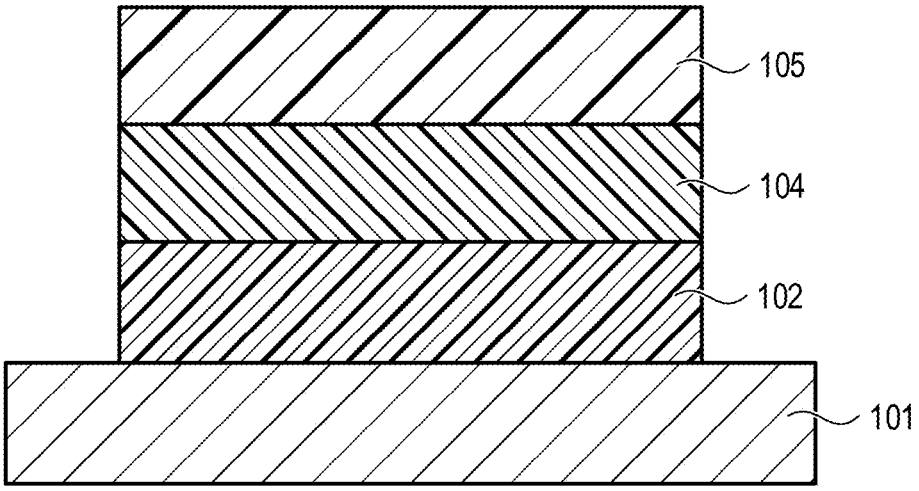
FIG. 4 is a view illustrating an example of a layer constitution of the electrophotographic photosensitive member.

FIG. 4 is a view showing an example of a layer constitution of an electrophotographic photosensitive member. In FIG. 4, a support 101, an undercoat layer 102 on the support 101, a charge generation layer 104 on the undercoat layer 102, and a charge transport layer 105 on the charge generation layer 104 are formed. That is, the electrophotographic photosensitive member sequentially has the support 101, the undercoat layer 102, the charge generation layer 104, and the charge transport layer 105.

As a general electrophotographic photosensitive member, a cylindrical electrophotographic photosensitive member made by forming a photosensitive layer (charge generation layer, charge transport layer) on a cylindrical support is widely used. Therefore, the electrophotographic photosensitive member according to the present invention can be a cylindrical electrophotographic photosensitive member, and may also have a belt-like shape, a sheet-like shape, or the like.

[Support]

The support preferably has conductivity (conductive support). For example, a support made of a metal such as aluminum, nickel, copper, gold, iron, or an alloy can be used.

In addition, as the conductive support, a support including a thin film of a conductive material such as metal, metal oxide, or the like, formed on an insulating support may be used. For example, a support including a thin film of a metal such as aluminum, silver, gold, or the like, or a support including a thin film of a conductive material such as indium oxide, tin oxide, or the like, formed on an insulating support such as a polyester resin, a polycarbonate resin, a polyimide resin, glass, or the like, may be included.

A surface of the support may be subjected to electrochemical treatment such as positive electrode oxidation, wet honing treatment, blast treatment, and cut treatment in order to improve electrical characteristics or suppress interference fringe.

[Conductive Layer]

A conductive layer may be formed between the support and an undercoat layer to be described below. The conductive layer may be obtained by forming a coating film of a coating liquid for a conductive layer in which conductive particles are dispersed in a resin on a support and drying.

Examples of the conductive particle may include metal powder such as carbon black, acetylene black, aluminum, nickel, iron, nichrome, copper, zinc and silver, conductive tin oxide, and metal oxide powder such as indium tin oxide.

In addition, examples of the resin may include a polyester resin, a polycarbonate resin, a polyvinyl butyral resin, an acrylic resin, a silicone resin, an epoxy resin, a melamine resin, an urethane resin, a phenol resin, and an alkyd resin.

Examples of a solvent of the coating liquid for a conductive layer may include an ether-based solvent, an alcohol-based solvent, a ketone-based solvent, and an aromatic hydrocarbon solvent.

A film thickness of the conductive layer is preferably 0.2 μm or more to 40 μm or less, more preferably 1 μm or more to 35 μm or less, and further preferably 5 μm or more to 30 μm or less.

[Charge Generation Layer]

A charge generation layer is formed directly on the undercoat layer.

Examples of a charge generation material may include an azo pigment, a perylene pigment, an anthraquinone derivative, an anthanthrone derivative, a dibenzpyrene quinone derivative, a pyranthrone derivative, a quinone pigment, an indigoid pigment, a phthalocyanine pigment, and a perinone pigment. Among these, the phthalocyanine pigment is preferred. Among the phthalocyanine pigments, oxytitanium phthalocyanine, chlorogallium phthalocyanine, and hydroxygallium phthalocyanine are preferred.

Examples of a binder resin used for the charge generation layer may include a polymer and a copolymer of a vinyl compound such as styrene, vinyl acetate, vinyl chloride, acrylic acid ester, methacrylic acid ester, vinylidene fluoride, or trifluoroethylene, polyvinyl alcohol, polyvinyl acetal, polycarbonate, polyester, polysulfone, polyphenylene oxide, polyurethane, cellulose resin, phenol resin, melamine resin, silicon resin, and epoxy resin. Among these, polyester, polycarbonate, and polyvinyl acetal are preferred.

In the charge generation layer, a ratio of the charge generation material and the binder resin (charge generation material/binder resin) preferably has a range of 10/1 to 1/10, and more preferably a range of 5/1 to 1/5.

Examples of a solvent used for a coating liquid for the charge generation layer may include an alcohol-based solvent, a ketone-based solvent, an ether-based solvent, an ester-based solvent, and an aromatic hydrocarbon solvent.

A film thickness of the charge generation layer is preferably 0.05 μm or more to 5 μm or less.

[Charge Transport Layer]

A charge transport layer is formed on the charge generation layer.

Examples of the charge transport material may include a hydrazone compound, a styryl compound, a benzidine compound, a butadiene compound, an enamine compound, a triarylamine compound, and triphenylamine. In addition, a polymer having a group derived from these compounds in a main chain or in a side chain may also be included.

Examples of a binder resin used for the charge transport layer may include polyester, polycarbonate, polymethacrylic acid ester, polyarylate, polysulfone, and polystyrene. Among these, the polycarbonate and the polyarylate are preferred. In addition, a weight average molecular weight (Mw) thereof preferably has a range of 10,000 to 300,000.

In the charge transport layer, a ratio of an charge transport material and a binder resin (charge transport material/binder resin) preferably has a range of 10/5 to 5/10, and more preferably a range of 10/8 to 6/10.

A film thickness of the charge transport layer is preferably 5 μm or more to 40 μm or less.

Examples of a solvent used for a coating liquid for the charge transport layer may include an alcohol-based solvent, a ketone-based solvent, an ether-based solvent, an ester-based solvent, an aromatic hydrocarbon solvent, and the like.

[Other Layers]

Other layers such as a second undercoat layer which is not included in the range of the undercoat layer in the present invention may be additionally provided between the support and the undercoat layer, separately from or in addition to the above-described conductive layer.

Otherwise, on the charge transport layer, a protection layer containing conductive particles or a charge transport material and a binder resin may be provided. The protection layer may further contain an additive such as a lubricant, or the like. In addition, the binder resin itself of the protection layer may have conductivity or charge transport property. In this case, the protection layer may not contain the conductive particles or the charge transport material other than the binder resin. Further, the binder resin of the protection layer may be a thermoplastic resin, or a curable resin obtained by curing using heat, light, radiation (electron beam, or the like), or the like.

[Method of Forming Each Layer]

As a method for forming each layer constituting an electrophotographic photosensitive member such as an undercoat layer, a charge generation layer, a charge transport layer, a conductive layer, or the like, the following method is preferred. That is, the method includes applying a coating liquid obtained by dissolving and/or dispersing a material constituting each layer in a solvent, and drying and/or curing the obtained coating film. Examples of the method of applying the coating liquid may include a dip applying method (dip coating method), a spray coating method, a curtain coating method, a spin coating method, and the like. Among these, the dip applying method is preferred in view of efficiency and productivity.

[Process Cartridge and Electrophotographic Apparatus]

FIG. 1 shows schematic construction of an electrophotographic apparatus including a process cartridge provided with an electrophotographic photosensitive member.

In FIG. 1, a cylindrical electrophotographic photosensitive member 1 is rotationally driven around a shaft 2 at a predetermined peripheral speed in a direction of an arrow. A surface (peripheral surface) of the electrophotographic photosensitive member 1 to be rotationally driven is charged to a predetermined positive or negative potential by a charging unit 3 (for example, a contact type charger, a non-contact type charger, or the like). Then, exposure is performed with exposure light (image exposure light) 4 from an exposure unit (not shown) such as slit exposure, laser beam scanning exposure, or the like. Thus, an electrostatic latent image corresponding to the target image is sequentially formed on the surface of the electrophotographic photosensitive member 1.

The electrostatic latent image formed on the surface of the electrophotographic photosensitive member 1 is then developed by a toner included in a developer of a developing unit 5 to become a toner image. The toner image formed and supported on the surface of the electrophotographic photosensitive member 1 is sequentially transferred from a transfer unit 6 (transfer roller, or the like) to a transfer material P (paper, or the like) by a transfer bias. In addition, the transfer material P is transported in the same period with rotation of the electrophotographic photosensitive member 1 in a part (an abutment part) between the electrophotographic photosensitive member 1 and the transfer unit 6 from a transfer material feeding unit (not shown).

The transfer material P after transferring the toner image is separated from the surface of the electrophotographic photosensitive member 1 and introduced into a fixing unit 8 to be subjected to image fixing, and is printed out of the apparatus as an image formation (print, copy).

The surface of the electrophotographic photosensitive member 1 after transferring the toner image becomes a clean surface by removing a transfer residual developer (transfer residual toner) using a cleaning unit 7 (cleaning blade, or the like.). Subsequently, the electrophotographic photosensitive member was subjected to charge elimination treatment by a pre-exposure light (not shown) from a pre-exposure unit (not shown), and is then used for repeated image formation. In addition, as shown in FIG. 1, when the charging unit 3 is a contact charging unit using a charging roller, the pre-exposure is not necessarily required.

A process cartridge may be constituted by housing the electrophotographic photosensitive member 1; and at least one unit in a container so as to be integrally supported, the at least one unit being selected from the group consisting of the charging unit 3, the developing unit 5, the transfer unit 6, and the cleaning unit 7, and the process cartridge may be detachably attachable to an electrophotographic apparatus main body. FIG. 1 shows a process cartridge 9 constituted by including an electrophotographic photosensitive member 1; and a charging unit 3, a developing unit 5, and a cleaning unit 7 so as to be integrally supported, and detachably attachable to an electrophotographic apparatus main body using a guide unit 10 such as a rail, or the like, of the electrophotographic apparatus main body.

According to the present invention, an electrophotographic photosensitive member in which close adhesiveness between an undercoat layer and a charge generation layer is improved and ghost phenomenon is reduced, and a process cartridge and an electrophotographic apparatus including the electrophotographic photosensitive member, can be provided.

EXAMPLE

Hereinafter, the present invention is described in more detail with reference to Examples. In the Examples, a "part" means a "mass part".

A Synthesis Example of an electron transport material is shown.

Synthesis Example 1

Under a nitrogen stream at room temperature, 26.8 g (100 mmol) of naphthalene-1,4,5,8-tetracarboxylic acid dianhydride and 250 ml of dimethylacetamide were added to a 500 ml three-necked flask. The obtained mixture was heated to 120° C., and 11.6 g (100 mmol) of 4-heptylamine was added dropwise thereto with stirring. After completion of the dropwise addition, the mixture was stirred for 3 hours.

Subsequently, a mixture of 9.2 g (100 mmol) of 2-amino-1,3-propanediol and 50 ml of dimethylacetamide was added dropwise with stirring. After completion of the dropwise addition, the mixture was heated under reflux for 6 hours. After completion of the reaction, a vessel was cooled and concentrated under reduced pressure. Ethyl acetate was added to a residue, followed by filtration, and a filtrate was purified by silica gel column chromatography. In addition, a recovered product was recrystallized with ethyl acetate/hexane to obtain 10.5 g of an electron transport material represented by Formula (A1-1) shown in Table 1.

This compound was measured by MALDI-TOF MS (Matrix Assisted Laser Desorption/Ionization-Time of Flight Mass Spectrometry), and a peak top value was obtained as 438.

Next, production and evaluation of an electrophotographic photosensitive member are described.

Example 1

An aluminum cylinder (JIS-A3003, aluminum alloy) having a length of 260.5 mm and a diameter of 30 mm was used as a support (conductive support).

Then, 214 parts of titanium oxide ($TiO_2$) particles coated with oxygen-deficient tin oxide ($SnO_2$) as metal oxide particles, 132 parts of a phenol resin as a binder resin (product name: Plyophene J-325 manufactured by DIC Corporation, solid content of 60 mass %), and 98 parts of 1-methoxy-2-propanol were put in a sand mill using 450 parts of a glass bead having a diameter of 0.8 mm, and were dispersed under conditions in which the number of revolutions was 2000 rpm, a dispersion treatment time was 4.5 hours, and a set temperature of a cooling water was 18° C. to prepare a dispersion liquid. From this dispersion liquid, the glass bead was removed with a mesh (pore size: 150 μm).

Silicone resin particles were added to the dispersion so as to be 10 mass % based on a total mass of the metal oxide particles and the binder resin in the dispersion liquid after removing the glass beads. Further, silicone oil was added to the dispersion liquid and stirred so as to be 0.01 mass % based on a total mass of the metal oxide particles and the binder resin in the dispersion liquid, thereby preparing a coating liquid for a conductive layer. The coating liquid for a conductive layer was dipped and applied on the support to form a coating film, and the obtained coating film was dried and thermally cured at 150° C. for 30 minutes to form a conductive layer having a film thickness of 30 μm. As silicone resin particles, TosPearl 120 (average particle size of 2 μm) manufactured by Momentive Performance Materials Inc., was used. As the silicone oil, SH28PA manufactured by Dow Corning Toray Co., Ltd., was used.

Then, 3.10 parts of the exemplary compound (A1-1) shown in Table 1 as an electron transport material, 0.36 parts of a styrene-acrylic resin (product name: UC-3920 manufactured by Toagosei Company, Limited) as a polyolefin resin, and 6.54 parts of a blocked isocyanate compound (product name: SBB-70P manufactured by Asahi Kasei Corporation) as an isocyanate compound were dissolved in a mixed solvent of 50 parts of 1-methoxy-2-propanol and 50 parts of tetrahydrofuran. To this solution, 1.8 parts of a silica slurry (product name: IPA-ST-UP manufactured by Nissan Chemical Industries, Limited, solid content concentration: 15 mass %, viscosity: 9 mPa·s) dispersed in isopropyl alcohol was added and stirred for 1 hour. Thereafter, the mixture was pressed and filtered using a Teflon (registered trademark) filter (product name: PF020) manufactured by ADVANTEC CO., LTD.

The thus obtained coating liquid for an undercoat layer was dipped and applied on the conductive layer, and the obtained coating film was heated at 170° C. for 40 minutes and cured (polymerized) to form an undercoat layer having a film thickness of 0.7 μm.

Then, a hydroxygallium phthalocyanine crystal (charge generation material) having strong peaks at 7.5°, 9.9°, 12.5°, 16.3°, 18.6°, 25.1° and 28.3° of Bragg angles (2θ±0.2°) in CuKα characteristic X-ray diffraction was prepared. The hydroxygallium phthalocyanine crystal (10 parts), 5 parts of polyvinyl butyral resin (product name: S-LEC BX-1 manufactured by Sekisui Chemical Company, Limited), and 250 parts of cyclohexanone were put in a sand mill using a glass bead having a diameter of 1 mm, and dispersed for 2 hours. Then, 250 parts of ethyl acetate was added to this solution to prepare a coating liquid for a charge generation layer. The coating liquid for a charge generation layer was dipped and applied on the undercoat layer to form a coating film, and the obtained coating film was dried at 95° C. for 10 minutes to form a charge generation layer having a film thickness of 0.15 μm.

Then, 6 parts of an amine compound (charge transport material) represented by Formula (2) below, 2 parts of an amine compound (charge transport material) represented by Formula (3) below, and 10 parts of a polyester resin having a weight-average molecular weight (Mw) of 100,000 and a structural unit represented by Formulas (4) and (5) below of a ratio of 5/5 were dissolved in a mixed solvent of 40 parts of dimethoxy methane and 60 parts of chlorobenzene to prepare a coating liquid for a charge transport layer.

(2)

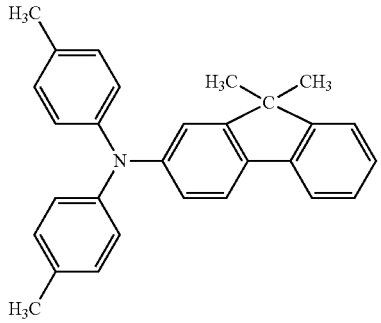

(3)

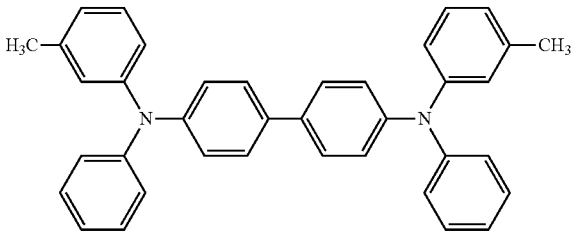

(4)

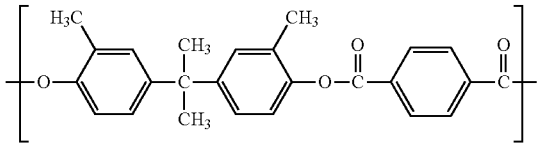

-continued (5)

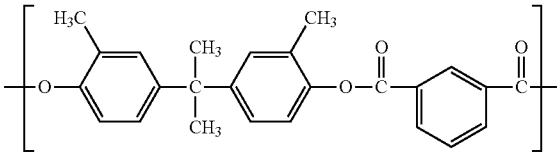

The coating liquid for a charge transport layer was dipped and applied on the charge generation layer, and the obtained coating film was dried at 120° C. for 40 minutes to form a charge transport layer having a film thickness of 23 Lm.

Thus, an electrophotographic photosensitive member having the conductive layer, the undercoat layer, the charge generation layer, and the charge transport layer formed on the support was manufactured.

[Evaluation of Close Adhesiveness]

The electrophotographic photosensitive member was subjected to a cross-cut test with 100 spaces each having a size of 1 mm×1 mm based on old JIS K5400, and an initial close adhesiveness of the electrophotographic photosensitive member was evaluated. Results were evaluated in 1 to 10 stages. The larger number means the better close adhesiveness. Then, the evaluation of close adhesiveness was performed similarly on the electrophotographic photosensitive member after 5,000 output (after durability treatment) with the following evaluation of Positive Ghost. The obtained results were shown in Table 4 below.

[Evaluation of Positive Ghost]

The electrophotographic photosensitive member for evaluating the positive ghost was mounted on a laser beam printer (product name: LBP-2510 manufactured by Canon Inc.) modified apparatus, and the following process conditions were set. In addition, evaluation of surface potential (potential variation) was performed. As the modification, a process speed was changed to 200 mm/s, and a dark part potential was −700 V so that a light amount of an exposure light (image exposure light) was varied. The details are as follows.

The manufactured electrophotographic photosensitive member was mounted on a process cartridge for cyan color of the laser beam printer that was modified so that stress applied to the electrophotographic photosensitive member is intensified by a cleaning blade under an environment of a temperature of 23° C. and a humidity of 50% RH, and the process cartridge was mounted on a station of the process cartridge of cyan. Then, image output (continuous image output in the order of one solid white image, five images for ghost evaluation, one solid black image, and five images for ghost evaluation) was performed.

Figure 2:
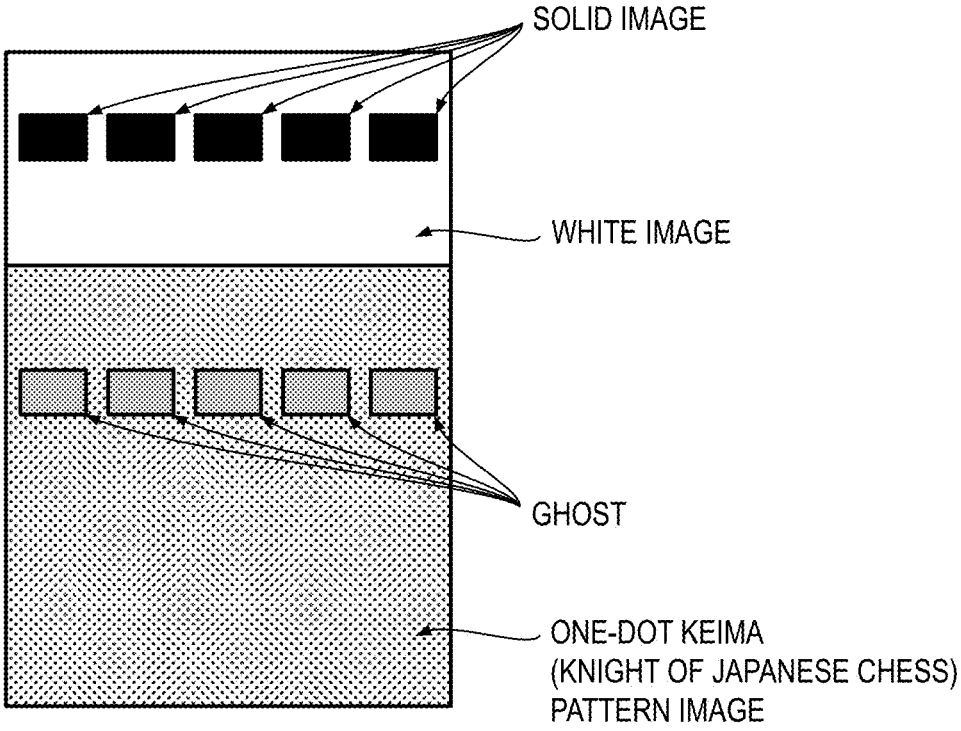
FIG. 2 is a view for explaining a printing for ghost evaluation used in ghost image evaluation.
Figure 3:
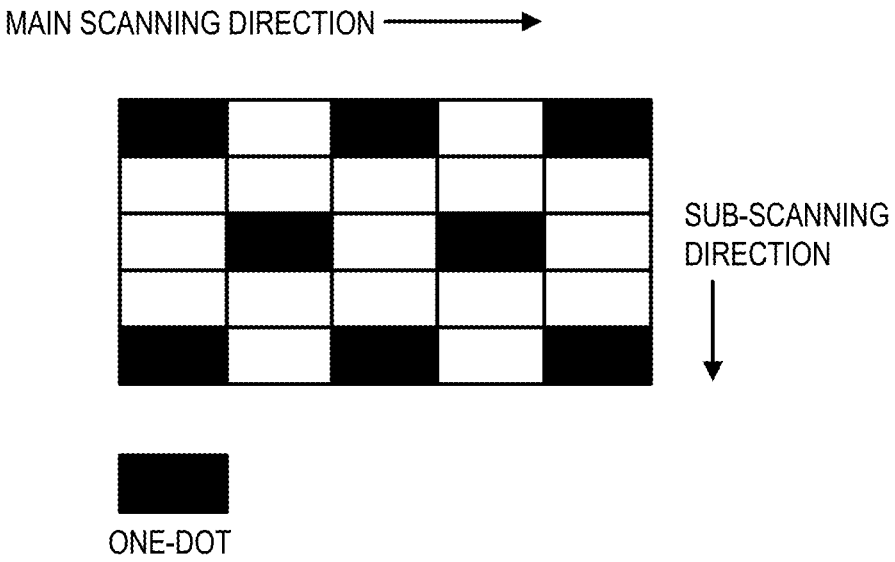
FIG. 3 is a view for explaining one-dot keima (knight of Japanese chess) patterns.

In the image for ghost evaluation as shown in FIG. 2, a square "solid image" in the "white image" is made in a head part of the image, and then a "halftone image of one-dot keima (knight of Japanese chess) patterns" shown in FIG. 3 is made. In addition, in FIG. 2, the "ghost" part is a part where ghost caused by "solid image" can appear.

The evaluation of the positive ghost was performed by measuring a concentration difference between an image concentration of a halftone image of the one-dot keima (knight of Japanese chess) patterns and an image concentration of the ghost part. By using a spectrophotometer (product name: X-Rite 504/508 manufactured by X-Rite Co., Ltd.), 10 points of the concentration difference in one image for ghost evaluation were measured. This operation was performed on all 10 images for ghost evaluation, and an average of 100 points in total was calculated.

Macbeth concentration difference (initial) at the time of initial image output was evaluated. Then, difference (variation) between Macbeth concentration difference after 5,000 output and Macbeth concentration difference at the time of the initial image output was calculated, and variation of the Macbeth concentration difference was calculated. Evaluation results of the positive ghost were shown in Table 4. The smaller Macbeth concentration difference means the more positive ghost is suppressed. In addition, the smaller difference between Macbeth concentration difference after 5,000 output and Macbeth concentration difference at the time of the initial image output means the smaller variation of the positive ghost.

Examples 2 to 23

An electrophotographic photosensitive member was manufactured in the same manner as in Example 1 except that the kind of the electron transport material, the polyolefin resin, and the isocyanate compound mixed in the coating liquid for an undercoat layer, the amount thereof, and the ratio between the charge generation material and the binder resin in the charge generation layer were changed as shown in Table 2, and evaluated in the same manner as in Example 1. Results thereof were shown in Table 4 below.

Example 24

An electrophotographic photosensitive member was manufactured in the same manner as in Example 1 except that the coating liquid for an undercoat layer was prepared and used as follows, and evaluated in the same manner as in Example 1. Results thereof were shown in Table 4 below.

Then, 3.28 parts of the exemplary compound (A1-1) shown in Table 1 as an electron transport material, 0.22 parts of a polyvinyl acetal resin (product name: KS-5Z manufactured by Sekisui Chemical Company, Limited), 0.22 parts of a styrene-acrylic resin (product name: UC-3920 manufactured by Toagosei Company, Limited) as a polyolefin resin, and 6.28 parts of a blocked isocyanate compound (product name: SBB-70P manufactured by Asahi Kasei Corporation) as an isocyanate compound were dissolved in a mixed solvent of 32 parts of acetone and 48 parts of 1-butanol. To this solution, 3.3 parts of a silica slurry (product name: IPA-ST-UP manufactured by Nissan Chemical Industries, Limited, solid content concentration: 15 mass %, viscosity: 9 mPa·s) dispersed in isopropyl alcohol was added and stirred for 1 hour. Thereafter, the mixture was pressed and filtered using a Teflon (registered trademark) filter (product name: PF020) manufactured by ADVANTEC CO., LTD.

The thus obtained coating liquid for an undercoat layer was dipped and applied on the conductive layer, and the obtained coating film was heated at 170° C. for 30 minutes and cured (polymerized) to form an undercoat layer having a film thickness of 0.7 μm.

Examples 25 to 27

An electrophotographic photosensitive member was manufactured in the same manner as in Example 24 except that the kind of the electron transport material, the polyolefin resin, and the isocyanate compound mixed in the coating liquid for an undercoat layer, the amount thereof, and the ratio between the charge generation material and the binder resin in the charge generation layer were changed as shown in Table 2, and evaluated in the same manner as in Example 24. Results thereof were shown in Table 4 below.

Example 28

An electrophotographic photosensitive member was manufactured in the same manner as in Example 24 except that the amount of the silica slurry dispersed in the isopropyl alcohol mixed in the coating liquid for an undercoat layer was changed to 0.5 parts, and evaluated in the same manner as in Example 24. Results thereof were shown in Table 4 below.

Example 29

An electrophotographic photosensitive member was manufactured in the same manner as in Example 24 except that the amount of the silica slurry dispersed in the isopropyl alcohol mixed in the coating liquid for an undercoat layer was changed to 5.0 parts, and evaluated in the same manner as in Example 24. Results thereof were shown in Table 4 below.

Example 30

An electrophotographic photosensitive member was manufactured in the same manner as in Example 24 except that the amount of the silica slurry dispersed in the isopropyl alcohol mixed in the coating liquid for an undercoat layer was changed to 6.0 parts, and evaluated in the same manner as in Example 24. Results thereof were shown in Table 4 below.

Comparative Example 1

An electrophotographic photosensitive member was manufactured in the same manner as in Example 1 except that the coating liquid for an undercoat layer was prepared and used as follows, and evaluated in the same manner as in Example 1. Results thereof were shown in Table 5 below.

Next, 4 parts of a compound represented by Formula (6) below, 0.54 parts of a polyvinyl acetal resin (product name: S-LEC KS-5Z manufactured by Sekisui Chemical Company, Limited), 7.8 parts of a blocked isocyanate compound (product name: SBN-70D manufactured by Asahi Kasei Corporation), and 0.08 parts of zinc (II) hexanoate (product name: zinc (II) hexanoate manufactured by MITSUWA CHEMICALS CO., LTD) were dissolved in a mixed solvent of 60 parts of dimethylacetamide and 60 parts of methyl ethyl ketone, thereby preparing a coating liquid for an undercoat layer.

(6)

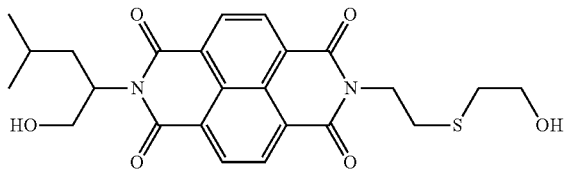

Comparative Example 2

An electrophotographic photosensitive member was manufactured in the same manner as in Example 1 except that the coating liquid for an undercoat layer was prepared and used as follows, and evaluated in the same manner as in Example 1. Results thereof were shown in Table 5 below.

A compound represented by Formula (7) (8 parts), 2 parts of a polyvinyl butyral resin (product name: S-LEC BX-1), 10 parts of a blocked isocyanate compound (product name: SBN-70D), 0.1 parts of zinc (II) hexanoate (product name: zinc (II) hexanoate) were dissolved in a mixed solvent of 100 parts of dimethylacetamide and 100 parts of methyl ethyl ketone, thereby preparing a coating liquid for an undercoat layer.

(7)

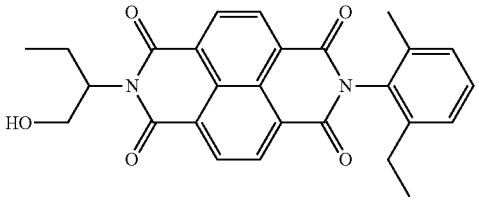

TABLE 2

| | Electron transport material | | Polyolefin resin | | Isocyanate compound | | Undercoat layer functional group | Charge generation layer constitution |
|---|---|---|---|---|---|---|---|---|
| Example | Kind | Amount | Kind | Amount | Kind | Amount | ratio | ratio |
| 1 | A1-1 | 3.10 | Resin 1 | 0.36 | Compound 1 | 6.54 | 1.0 | 2.0 |
| 2 | A1-2 | 3.10 | Resin 1 | 0.36 | Compound 1 | 6.54 | 1.0 | 2.0 |
| 3 | A1-1 | 3.07 | Resin 2 | 0.24 | Compound 1 | 6.69 | 1.0 | 2.0 |
| 4 | A1-6 | 3.12 | Resin 3 | 0.40 | Compound 1 | 6.48 | 1.0 | 2.0 |
| 5 | A1-7 | 3.10 | Resin 1 | 0.36 | Compound 2 | 6.41 | 1.0 | 2.0 |
| 6 | A1-9 | 3.07 | Resin 2 | 0.24 | Compound 2 | 6.69 | 1.0 | 2.0 |
| 7 | A1-10 | 3.25 | Resin 3 | 0.40 | Compound 2 | 6.48 | 1.0 | 2.0 |
| 8 | A8-1 | 3.10 | Resin 1 | 0.36 | Compound 1 | 6.41 | 1.0 | 2.0 |
| 9 | A8-2 | 3.10 | Resin 1 | 0.36 | Compound 1 | 6.41 | 1.0 | 2.0 |
| 10 | A9-1 | 3.10 | Resin 1 | 0.36 | Compound 1 | 6.41 | 1.0 | 2.0 |
| 11 | A11-1 | 3.10 | Resin 1 | 0.36 | Compound 1 | 6.41 | 1.0 | 2.0 |
| 12 | A1-1/A8-1 | 1.63/1.63 | Resin 1 | 0.34 | Compound 1 | 6.40 | 1.0 | 2.0 |
| 13 | A1-1 | 3.12 | Resin 1/Resin 4 | 0.20/0.20 | Compound 1 | 6.48 | 1.0 | 2.0 |
| 14 | A1-1 | 3.10 | Resin 2/Resin 4 | 0.15/0.15 | Compound 2 | 6.60 | 1.0 | 2.0 |
| 15 | A1-2 | 3.10 | Resin 1 | 0.36 | Compound 3 | 6.54 | 1.0 | 2.0 |
| 16 | A1-4 | 3.25 | Resin 1 | 0.75 | Compound 1 | 6.00 | 0.8 | 2.0 |
| 17 | A1-5 | 3.00 | Resin 1 | 0.05 | Compound 1 | 6.95 | 1.2 | 2.0 |
| 18 | A1-1 | 3.12 | Resin 1/Resin 4 | 0.02/0.38 | Compound 1 | 6.48 | 1.0 | 2.0 |
| 19 | A1-1 | 3.12 | Resin 1/Resin 4 | 0.02/0.38 | Compound 1 | 6.48 | 1.0 | 0.9 |
| 20 | A1-2 | 3.13 | Resin 1/Resin 4 | 0.05/0.38 | Compound 2 | 6.44 | 1.0 | 2.0 |
| 21 | A1-1 | 2.93 | Resin 2 | 0.62 | Compound 1 | 6.45 | 0.9 | 2.0 |
| 22 | A1-1 | 3.10 | Resin 1 | 0.36 | Compound 1 | 6.54 | 1.0 | 3.0 |
| 23 | A1-1 | 3.10 | Resin 1 | 0.36 | Compound 1 | 6.54 | 1.0 | 4.0 |
| 24 | A1-1 | 3.28 | Resin 1/Resin 4 | 0.22/0.22 | Compound 1 | 6.28 | 1.0 | 2.0 |
| 25 | A1-1 | 3.63 | Resin 1/Resin 4 | 0.02/0.02 | Compound 1 | 6.33 | 1.0 | 2.0 |
| 26 | A1-1 | 3.12 | Resin 1/Resin 4 | 0.31/0.31 | Compound 1 | 6.26 | 1.0 | 2.0 |
| 27 | A1-1 | 2.79 | Resin 1/Resin 4 | 0.50/0.50 | Compound 1 | 6.22 | 1.0 | 2.0 |
| 28 | A1-1 | 3.28 | Resin 1/Resin 4 | 0.22/0.22 | Compound 1 | 6.28 | 1.0 | 2.0 |
| 29 | A1-1 | 3.28 | Resin 1/Resin 4 | 0.22/0.22 | Compound 1 | 6.28 | 1.0 | 2.0 |
| 30 | A1-1 | 3.28 | Resin 1/Resin 4 | 0.22/0.22 | Compound 1 | 6.28 | 1.0 | 2.0 |

Further, "undercoat layer functional group ratio" in Table indicates "ratio between a material amount of an isocyanate group included in a composition before curing a cured product contained in the undercoat layer and a total of a material amount of a polymerizable functional group of the electron transport material and a carboxyl group, an alkoxycarbonyl group and an anhydrous carboxylic acid included in the polyolefin resin (represented by isocyanate group/(polymerizable functional group+carboxyl group, alkoxycarbonyl group, and anhydrous carboxylic acid))", and "charge generation layer composition ratio" indicates "ratio between a charge generation material and a binder resin in a charge generation layer (represented by charge generation material/binder resin)".

TABLE 3

| Comparative | Electron transport material | | Polyolefin resin | | Isocyanate compound | |
|---|---|---|---|---|---|---|
| Example | Kind | Amount | Kind | Amount | Kind | Amount |
| 1 | (6) | 4.00 | Resin 4 | 0.54 | Compound 3 | 7.80 |
| 2 | (7) | 8.00 | Resin 5 | 2.00 | Compound 3 | 10.00 |

TABLE 4

| | Evaluation of close adhesiveness | | | |
|---|---|---|---|---|
| | | After durability | Evaluation of positive ghost | |
| Example | Initial | treatment | Initial | Variation |
| 1 | 10 | 9 | 0.024 | 0.005 |
| 2 | 10 | 9 | 0.025 | 0.006 |

TABLE 4-continued

| | Evaluation of close adhesiveness | | | |
|---|---|---|---|---|
| | | After durability | Evaluation of positive ghost | |
| Example | Initial | treatment | Initial | Variation |
| 3 | 9 | 8 | 0.027 | 0.006 |
| 4 | 8 | 8 | 0.025 | 0.007 |

TABLE 4-continued

| Example | Evaluation of close adhesiveness: Initial | After durability treatment | Evaluation of positive ghost: Initial | Variation |
|---|---|---|---|---|
| 5 | 8 | 8 | 0.030 | 0.008 |
| 6 | 9 | 8 | 0.029 | 0.008 |
| 7 | 8 | 8 | 0.029 | 0.007 |
| 8 | 10 | 9 | 0.020 | 0.002 |
| 9 | 10 | 8 | 0.020 | 0.003 |
| 10 | 7 | 6 | 0.033 | 0.019 |
| 11 | 7 | 4 | 0.020 | 0.021 |
| 12 | 10 | 8 | 0.022 | 0.003 |
| 13 | 10 | 9 | 0.024 | 0.006 |
| 14 | 9 | 8 | 0.023 | 0.005 |
| 15 | 7 | 3 | 0.025 | 0.019 |
| 16 | 10 | 9 | 0.033 | 0.021 |
| 17 | 10 | 9 | 0.035 | 0.020 |
| 18 | 7 | 4 | 0.024 | 0.024 |
| 19 | 10 | 7 | 0.023 | 0.025 |
| 20 | 8 | 8 | 0.025 | 0.008 |
| 21 | 10 | 8 | 0.028 | 0.007 |
| 22 | 9 | 6 | 0.023 | 0.007 |
| 23 | 7 | 4 | 0.023 | 0.023 |
| 24 | 10 | 9 | 0.024 | 0.006 |
| 25 | 8 | 8 | 0.020 | 0.008 |
| 26 | 10 | 10 | 0.030 | 0.006 |
| 27 | 10 | 10 | 0.030 | 0.023 |
| 28 | 10 | 9 | 0.030 | 0.010 |
| 29 | 10 | 9 | 0.023 | 0.005 |
| 30 | 10 | 9 | 0.036 | 0.025 |

TABLE 5

| Comparative Example | Evaluation of close adhesiveness: Initial | After durability treatment | Evaluation of positive ghost: Initial | Variation |
|---|---|---|---|---|
| 1 | 8 | 3 | 0.031 | 0.040 |
| 2 | 7 | 2 | 0.025 | 0.043 |

In Tables 2 and 3, the electron transport materials A8-1, A8-2, A9-1, and A11-1 are compounds represented by Formula below.

In addition, a resin 1 is a styrene-acrylic resin (product name: UC-3920 manufactured by Toagosei Company, Limited), a resin 2 is a styrene-maleic acid resin (product name: SMA1000 manufactured by Cray Valley HSC), a resin 3 is a styrene-maleic acid resin (product name: X-200 manufactured by Seiko PMC Corporation), a resin 4 is a polyvinyl acetal resin (product name: KS-5Z manufactured by Sekisui Chemical Company, Limited), and a resin 5 is a polyvinyl butyral resin (product name: BX-1 manufactured by Sekisui Chemical Company, Limited).

In addition, a compound 1 represents a blocked isocyanate compound (product name: SBB-70P manufactured by Asahi Kasei Corporation), a compound 2 represents a blocked isocyanate compound (product name: 17B-60P manufactured by Asahi Kasei Corporation), and a compound 3 represents a blocked isocyanate compound (product name: SBN-70D manufactured by Asahi Kasei Corporation).

(A8-1)

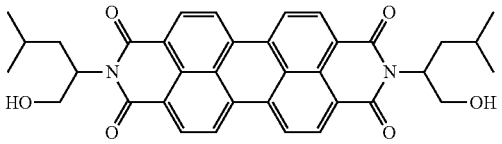

(A8-2)

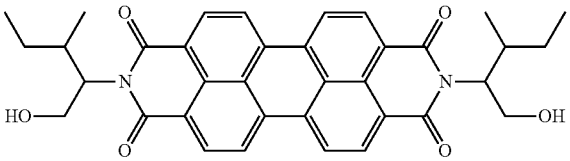

(A9-1)

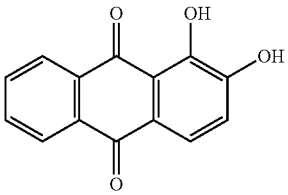

(A11-1)

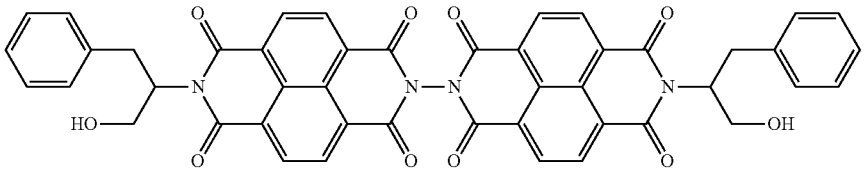

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-103902, filed May 25, 2017, which is hereby incorporated by reference herein in its entirety.

What is claimed is:

1. An electrophotographic photosensitive member comprising in this order:

a support;

an undercoat layer comprising a cured product of an electron transport material, a polyolefin resin and an isocyanate compound having two or more isocyanate groups;

a charge generation layer; and a charge transport layer, wherein the electron transport material has at least one member selected from the group consisting of a hydroxyl group, a thiol group, an amino group and a carboxyl group, and the polyolefin resin has at least one member selected from the group consisting of a carboxyl group, an alkoxycarbonyl group and an anhydrous carboxylic acid structure and an optionally substituted phenyl group, the polyolefin resin having a structure represented by formula (B1) and a structure represented by formula (B2)

(B1)

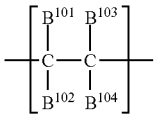

where $B^{101}$ to $B^{104}$ are independently selected from the group consisting of a hydrogen atom, a methyl group and an optionally substituted phenyl group, and at least one of $B^{101}$ to $B^{104}$ is said optionally substituted phenyl group (B2)

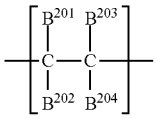

where $B^{201}$ to $B^{204}$ are independently selected from the group consisting of a hydrogen atom, a methyl group, a carboxyl group and an alkoxycarbonyl group, and at least one of $B^{201}$ to $B^{204}$ is said carboxyl or alkoxycarbonyl group, or $B^{201}$ and $B^{203}$ are independently a hydrogen atom or a methyl group, and $B^{202}$ and $B^{204}$ are bonded in a structure of —C(=O)OC(=O)—, thereby forming a ring structure with C—C in formula (B2).

2. The electrophotographic photosensitive member according to claim 1, wherein the isocyanate compound is a biuret-type isocyanate compound.

3. The electrophotographic photosensitive member according to claim 1, wherein the electron transport material is represented by formula (A1)

(A1)

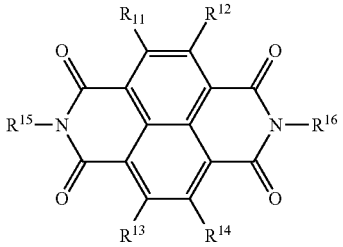

where, $R^{15}$ and $R^{16}$ are each independently an optionally substituted alkyl group having 2 to 6 carbon atoms, a group derived by substituting at least one $CH_2$ in a main chain of an optionally substituted alkyl group having 3 to 6 carbon atoms in the main chain with an oxygen atom, a group derived by substituting at least one $CH_2$ in the main chain of the optionally substituted alkyl group having 3 to 6 carbon atoms in the main chain with $NR^{124}$, a group derived by substituting at least one $C_2H_4$ in the main chain of the optionally substituted alkyl group having 3 to 6 carbon atoms in the main chain with COO or a substituted aryl group, $R^{124}$ represents a hydrogen atom or an alkyl group having 1 to 4 carbon atoms, a substituent of the substituted alkyl group, a group derived by substituting at least one $CH_2$ in the main chain of the substituted alkyl group with an oxygen atom, a group derived by substituting at least one $CH_2$ in the main chain of the substituted alkyl group with $NR^{124}$ and a group derived by substituting at least one $C_2H_4$ in the main chain of the substituted alkyl group with COO is selected from the group consisting of an alkyl group having 1 to 5 carbon atoms, a benzyl group, an alkoxycarbonyl group, a phenyl group, a hydroxyl group, a thiol group, an amino group and a carboxyl group, the substituent of the substituted aryl group is selected from the group consisting of a halogen atom, a cyano group, a nitro group, a methyl group, an ethyl group, an isopropyl group, an n-propyl group, an n-butyl group, an acyl group, an alkoxy group, an alkoxycarbonyl group, a hydroxyl group, a thiol group, an amino group and a carboxyl group, and comprises at least one hydroxyl or carboxyl group, and $R^{11}$ to $R^{14}$ independently represent a hydrogen atom, a halogen atom, a cyano group, a nitro group, an optionally substituted alkyl group having 1 to 6 carbon atoms, or an optionally substituted aryl group.

4. The electrophotographic photosensitive member according to claim 1, wherein the electron transport material included in the undercoat layer has an amount of 45 to 55 mass % of the entire undercoat layer.

5. The electrophotographic photosensitive member according to claim 1, wherein the undercoat layer comprises silica particles having a number average particle diameter of 0.1 μm or less in an amount of 10.0 mass % or less of the entire undercoat layer.

6. The electrophotographic photosensitive member according to claim 1, wherein a ratio between a material amount of the isocyanate group included in a composition before curing the cured product included in the undercoat layer and a total of a material amount of a polymerizable functional group of the electron transport material and the carboxyl group, the alkoxycarbonyl group and the anhydrous carboxylic acid included in the polyolefin resin is 0.9 to 1.1 represented by (isocyanate group/(polymerizable functional group+carboxyl group±alkoxycarbonyl group±anhydrous carboxylic acid)).

7. The electrophotographic photosensitive member according to claim 1, wherein the polyolefin resin included in the undercoat layer has an amount of 0.2 to 8.0 mass % of the entire undercoat layer, and the charge generation layer contains a phthalocyanine pigment and a resin at a ratio of 1.0 to 3.0 represented by (phthalocyanine pigment/resin).

8. A process cartridge, comprising:

an electrophotographic photosensitive member and at least one unit that is integrally supported being selected from the group consisting of a charging unit, a developing unit and a cleaning unit, said process cartridge being detachably attachable to an electrophotographic apparatus main body; and the electrophotographic photosensitive member comprising in this order a support, an undercoat layer, a charge generation layer and a charge transport layer, said undercoat layer comprising a cured product of an electron transport material, a polyolefin resin and an isocyanate compound having two or more isocyanate groups, wherein the electron transport material has at least one member selected from the group consisting of a hydroxyl group, a thiol group, an amino group and a carboxyl group, and the polyolefin resin has at least one member selected from the group consisting of a carboxyl group, an alkoxycarbonyl group and an anhydrous carboxylic acid structure and an optionally substituted phenyl group, the polyolefin resin having a structure represented by formula (B1) and a structure represented by formula (B2)

(B1)

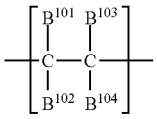

where $B^{101}$ to $B^{104}$ are independently selected from the group consisting of a hydrogen atom, a methyl group and an optionally substituted phenyl group, and at least one of $B^{101}$ to $B^{104}$ is said optionally substituted phenyl group (B2)

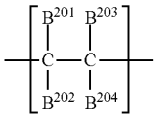

where $B^{201}$ to $B^{204}$ are independently selected from the group consisting of a hydrogen atom, a methyl group, a carboxyl group and an alkoxycarbonyl group, and at least one of $B^{201}$ to $B^{204}$ is said carboxyl or alkoxycarbonyl group, or $B^{201}$ and $B^{203}$ are independently a hydrogen atom or a methyl group, and $B^{202}$ and $B^{204}$ are bonded in a structure of —C(=O)OC(=O)—, thereby forming a ring structure with C—C in formula (B2).

9. An electrophotographic apparatus, comprising:

an electrophotographic photosensitive member, a charging unit, an exposing unit, a developing unit and a transfer unit;

the electrophotographic photosensitive member comprising in this order a support, an undercoat layer, a charge generation layer and a charge transport layer, said undercoat layer comprising a cured product of an electron transport material, a polyolefin resin and an isocyanate compound having two or more isocyanate groups, wherein the electron transport material has at least one member selected from the group consisting of a hydroxyl group, a thiol group, an amino group and a carboxyl group, and the polyolefin resin has at least one member selected from the group consisting of a carboxyl group, an alkoxycarbonyl group and an anhydrous carboxylic acid structure and an optionally substituted phenyl group, the polyolefin resin having a structure represented by formula (B1) and a structure represented by formula (B2)

(B1)

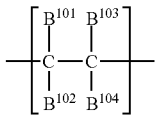

where $B^{101}$ to $B^{104}$ are independently selected from the group consisting of a hydrogen atom, a methyl group and an optionally substituted phenyl group, and at least one of $B^{101}$ to $B^{104}$ is said optionally substituted phenyl group (B2)

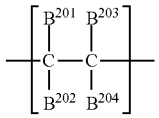

where $B^{201}$ to $B^{204}$ are independently selected from the group consisting of a hydrogen atom, a methyl group, a carboxyl group and an alkoxycarbonyl group, and at least one of $B^{201}$ to $B^{204}$ is said carboxyl or alkoxycarbonyl group, or $B^{201}$ and $B^{203}$ are independently a hydrogen atom or a methyl group, and $B^{202}$ and $B^{204}$ are bonded in a structure of —C(=O)OC(=O)—, thereby forming a ring structure with C—C in formula (B2).

* * * * *